United States Patent [19]

Kronberg et al.

[11] 4,338,984

[45] Jul. 13, 1982

[54] AUTOMOTIVE FLUID SUPPLY FUNNEL UNIT

[76] Inventors: Richard E. Kronberg, 2601 Knox Ave. N., Minneapolis, Minn. 55411; Merlin L. Walters, 3214 Girard Ave. N., Minneapolis, Minn. 55412

[21] Appl. No.: 176,923

[22] Filed: Aug. 11, 1980

[51] Int. Cl.[3] ..... B65B 39/00

[52] U.S. Cl. ..... 141/331; 141/337

[58] Field of Search ..... 141/331-345, 141/98

[56] References Cited

FOREIGN PATENT DOCUMENTS 144228 6/1920 United Kingdom ..... 141/337

*Primary Examiner*—James E. Bryant, III

*Attorney, Agent, or Firm*—Wayne B. Easton

[57] ABSTRACT

A funnel unit for use with automotive type vehicles. A motor vehicle requires periodic checking and maintenance of crankcase oil levels and transmission fluid levels. The crankcase oil inlet is normally near to top of the engine and is conveniently accessible. The transmission fluid inlet, however, is normally near the lower part of the engine block and this not readily accessible. The funnel unit herein has two detachable main parts which are a cone member and an elongated tube member. When these two parts are attached the elongated tube facilitates access to the transmission inlet. The elongated tube may in some cases impede use of the assembled funnel unit for adding oil to the crankcase inlet, however, and in such case the two parts are separated from each other and cone member alone is used for adding oil to the crankcase. An added feature is that the funnel unit may be made of a cheap material such as cardboard or plastic and be utilized as a disposable unit which is sold cheaply at a self-service gasolene station for a one-time use expediency.

1 Claim, 6 Drawing Figures

AUTOMOTIVE FLUID SUPPLY FUNNEL UNIT

The invention relates to a funnel unit for use with automotive type vehicles. A motor vehicle requires periodic checking and maintenance of crankcase oil levels and transmission fluid levels. The crankcase oil inlet is normally near the top of the engine and is conveniently accessible. The transmission fluid inlet, however, is normally near the lower part of the engine block and thus is not readily accessible. The funnel unit herein has two detachable main parts which are a cone member and an elongated tube member. When these two parts are attached the elongated tube facilitates access to the transmission inlet. The elongated tube may in some cases impede use of the assembled funnel unit for adding oil to the crankcase inlet, however, and in such case the two parts are separated from each other and cone member alone is used for adding oil to the crankcase. An added feature is that the funnel unit may be made of a cheap material such as cardboard or plastic and be utilized as a disposable unit which is sold cheaply at a self-service gasoline station for a one time use expediency.

A main object of the invention is to provide a new and improved funnel unit of the type described above.

Figure 1:
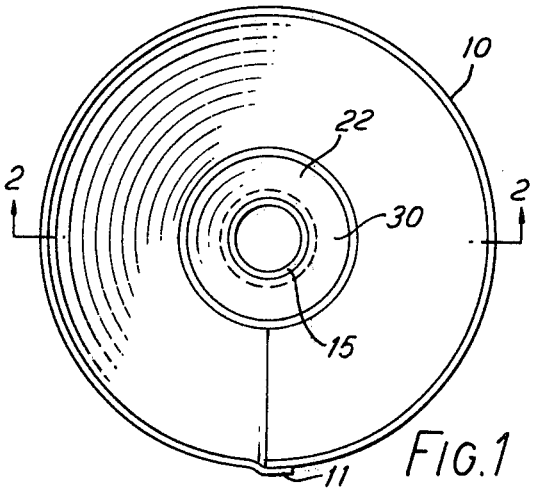
FIG. 1 is a plan view of an automotive fluid supply funnel unit embodying the invention.
Figure 3:
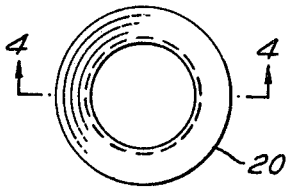
FIG. 3 is a plan view of a first conically shaped sleeve insert which is a part of the assembly shown in FIGS. 1 and 2.
Figure 4:
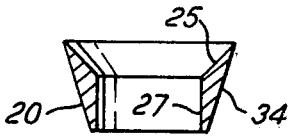
FIG. 4 is a vertical sectional view taken on line 4—4 of FIG. 3.

The fluid supply funnel of the present invention comprises a frustoconically shaped cone member 10 which is preferably made of a cardboard or a light gauge plastic sheet material. Cone member 10 may have an included angle of about 40° but this may vary substantially as desired. Cone member 10 may be made in a variety of ways such as by vacuum forming, if made of a plastic material or, if developed from a flat cardboard layout, may have a seam 11 which is formed by gluing.

A tube 15 having an outer diameter nominally equal to the inner diameter of the small end of the cone member 10 may likewise be made of cardboard or plastic.

A frustoconically shaped sleeve member 20 is glued or otherwise fastened to the upper end of tube 15. A frustoconically shaped sleeve member is glued or otherwise fastened to the inside of the lower end of the cone member 10.

Sleeve members 20 and 22 may be made of Styrofoam or a like material. These members have complementary formed, inwardly and outwardly tapered surfaces 25 and 26 which are mirror images of each other and cylindrically shaped bores 27 and 28 of nominally equal diameter.

Figure 2:
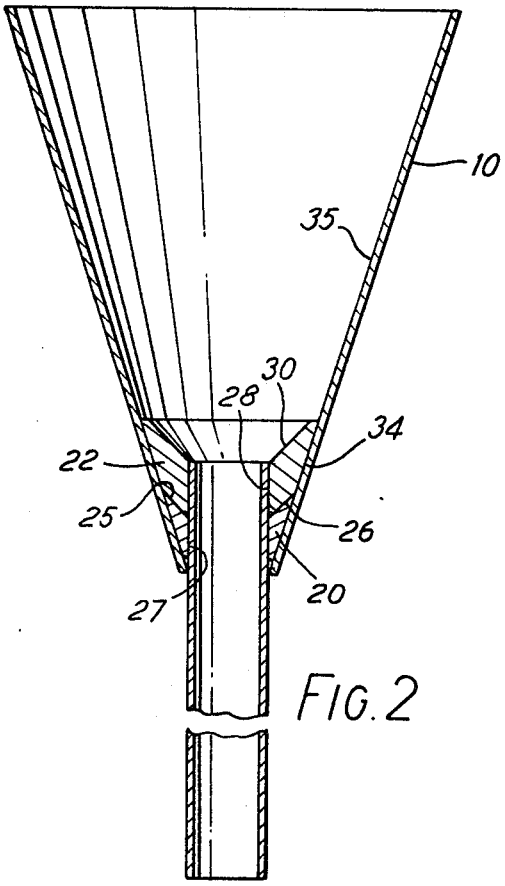
FIG. 2 is a vertical sectional view taken on line 2—2 of FIG. 1.
Figure 5:
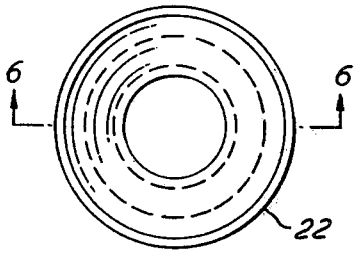
FIG. 5 is a plan view of a second conically shaped sleeve insert which is a part of the assembly shown in FIGS. 1 and 2.
Figure 6:
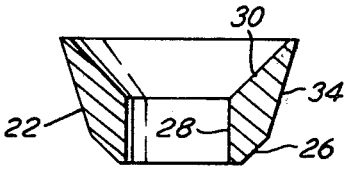
FIG. 6 is a vertical sectional view taken on line 6—6 of FIG. 5.

The funnel unit may be sold assembled as shown in FIGS. 1 and 2 or disassembled with the cone member 10 separated from the tube 15. If the funnel unit is being used to supply fluid to a vehicle transmission having its inlet near the lower part of the engine block, the funnel unit would be assembled by the user by inserting the tube 15 downwardly through the top of the funnel member 10 to the illustrated position. In this position the insert surface 25 and 26 are in abutting and sealing engagement to prevent leakage from cone member 10 to the outside of tube 15.

Sleeve member 22 has a dished, upwardly facing surface 30 which is formed to funnel or direct liquid from the cone member 10 to the tube 15. Also, the bore 27 of sleeve member 20 has a slightly smaller diameter than the outer diameter of tube 15 to provide a press fit to facilitate holding the cone member 10 and tube 15 together and to also prevent leakage from occurring between sleeve member 20 and tube 15.

For the same purpose, the outer tapered surface 34 of sleeve member 22 and the inner conical surface of cone member 10 are mutually formed for abutting and sealing engagement to aid in holding cone member 10 in an attached position relative to tube 15 and to prevent leakage from the inside of cone member 10 to the exterior of tube 15.

As the overall length of the funnel unit may be on the order of about sixteen inches, the assembled unit will normally not be too convenient for adding oil to the crankcase through the filler tube which has its inlet at a level near the top of the engine. In that case only the cone member 10 may be used for that purpose and, in preparation thereof, the tube 15 is either withdrawn from the cone member 10 or is not attached initially, as the case may be.

We claim:

1. A two part detachable funnel unit for use with automotive vehicles, comprising, a frustoconically shaped cone member, an elongated tube member positioned at one end of the frustoconically shaped cone member, a first generally conically shaped sleeve means attached to the lower end of the frustoconically shaped cone member, a second generally conically shaped sleeve means attached to the upper end of the elongated tube member, said first and second sleeve means being made of a yieldable material and having complementary conically shaped surfaces which provide sealing between said surfaces, said members are assembled and said complementary conically shaped surfaces are pressed together to form a press fit, said press fit serving to make said members readily attachable and detachable and to provide sealing between said members.

* * * * *